US011338188B2

(12) United States Patent
Kueker et al.

(10) Patent No.: US 11,338,188 B2
(45) Date of Patent: May 24, 2022

(54) BRAKING MECHANISM FOR A SELF-POWERED TREADMILL

(71) Applicant: True Fitness Technology, Inc.

(72) Inventors: Jared M. Kueker, St. Charles, MO (US); David L. Green, St. Charles, MO (US); Dennis L. Meyerotto, St. Charles, MO (US)

(73) Assignee: True Fitness Technology, Inc., O'Fallon, MO (US)

( * ) Notice: Subject to any disclaimer, the term of this patent is extended or adjusted under 35 U.S.C. 154(b) by 0 days.

(21) Appl. No.: 16/252,249

(22) Filed: Jan. 18, 2019

(65) Prior Publication Data

US 2019/0217182 A1 Jul. 18, 2019

Related U.S. Application Data

(60) Provisional application No. 62/618,800, filed on Jan. 18, 2018.

(51) Int. Cl.
*A63B 71/00* (2006.01)
*A63B 24/00* (2006.01)
(Continued)

(52) U.S. Cl.
CPC ..... *A63B 71/0054* (2013.01); *A63B 1/00* (2013.01); *A63B 22/0235* (2013.01); *A63B 22/0285* (2013.01); *A63B 24/0087* (2013.01)

(58) Field of Classification Search
CPC . A63B 22/02; A63B 22/0207; A63B 22/0214; A63B 22/0221; A63B 22/0228; A63B 22/0235; A63B 22/0242; A63B 22/025; A63B 22/0257; A63B 22/0264; A63B 22/0285; A63B 22/0292; A63B 2022/0271; A63B 2022/0278; A63B 71/0054; A63B 22/0023; A63B 21/0056; A63B 24/0087; A63B 21/0085; A63B 21/008; A63B 2071/0081; A63B 21/015;
(Continued)

(56) References Cited

U.S. PATENT DOCUMENTS 4,713,567 A 12/1987 Fey et al.
5,104,119 A 4/1992 Lynch
(Continued)

FOREIGN PATENT DOCUMENTS

CN 2319090 Y 5/1999
CN 202146547 U 2/2012
(Continued)

OTHER PUBLICATIONS

International Search Report, International Patent Application No. PCT/US2018/012229, dated Apr. 30, 2018 (18 pages).
(Continued)

*Primary Examiner* — Nyca T Nguyen
*Assistant Examiner* — Zachary T Moore
(74) *Attorney, Agent, or Firm* — Lewis Rice LLC

(57) ABSTRACT

A mechanical braking system which can provide a brake to a self-powered treadmill, or a dual mode treadmill that can operate in both self-powered and motor-powered modes, that will rapidly halt the motion of the belt or rollers in the event of a power disconnect such as from the removal of a safety key.

14 Claims, 3 Drawing Sheets

(51) Int. Cl.
*A63B 22/02* (2006.01)
*A63B 1/00* (2006.01)

(58) Field of Classification Search
CPC ..... A63B 21/225; A63B 2220/30; A63B 2220/18; A63B 21/005; A63B 21/0057; A63B 21/0058; A63B 21/0059
See application file for complete search history.

(56) References Cited

U.S. PATENT DOCUMENTS

| | | | | |
|---|---|---|---|---|
| 5,318,487 | A | 6/1994 | Golen et al. | |
| 5,361,022 | A | 11/1994 | Brown | |
| 5,374,227 | A | 12/1994 | Webb | |
| 5,470,293 | A * | 11/1995 | Schonenberger | B65G 23/06 482/54 |
| 5,643,142 | A | 7/1997 | Salerno et al. | |
| 5,685,804 | A | 11/1997 | Whan-Tong et al. | |
| 5,747,955 | A | 5/1998 | Rotunda et al. | |
| 5,856,736 | A | 1/1999 | Rotunda et al. | |
| 5,944,635 | A | 8/1999 | Butler, Jr. | |
| 6,095,951 | A | 8/2000 | Skowronski et al. | |
| 6,908,416 | B2 | 6/2005 | Mercado et al. | |
| 7,517,303 | B2 | 4/2009 | Crawford et al. | |
| 7,559,879 | B2 | 7/2009 | Anderson et al. | |
| 7,621,850 | B2 | 11/2009 | Piaget et al. | |
| 7,811,209 | B2 | 10/2010 | Crawford et al. | |
| 7,862,483 | B2 | 1/2011 | Henrickson et al. | |
| 7,988,599 | B2 | 8/2011 | Ainsworth et al. | |
| 8,157,706 | B2 | 4/2012 | Ainsworth et al. | |
| 8,343,016 | B1 * | 1/2013 | Astilean | A63B 22/0221 482/54 |
| 8,403,816 | B2 | 3/2013 | Park | |
| 8,690,738 | B1 * | 4/2014 | Astilian | A63B 22/02 482/54 |
| 9,216,317 | B2 | 12/2015 | Golen, Jr. et al. | |
| 9,233,272 | B2 | 1/2016 | Villani et al. | |
| 9,623,281 | B2 | 4/2017 | Henderickson et al. | |
| 9,987,516 | B1 * | 6/2018 | Chen | A63B 21/4035 |
| 10,238,912 | B2 * | 3/2019 | Chen | A63B 21/4034 |
| 10,478,666 | B2 * | 11/2019 | Yoo | A63B 22/0285 |
| 2005/0009668 | A1 | 1/2005 | Savettiere et al. | |
| 2007/0123396 | A1 | 5/2007 | Ellis | |
| 2009/0137367 | A1 * | 5/2009 | Hendrickson | A63B 24/00 482/54 |
| 2012/0010053 | A1 * | 1/2012 | Bayerlein | A63B 23/04 482/54 |
| 2012/0157267 | A1 * | 6/2012 | Lo | A63B 22/02 482/54 |
| 2012/0264572 | A1 | 10/2012 | Fenster et al. | |
| 2014/0187387 | A1 | 7/2014 | Fenster et al. | |
| 2014/0221160 | A1 | 8/2014 | Hardy et al. | |
| 2016/0067537 | A1 | 3/2016 | Bayerlein et al. | |
| 2016/0175643 | A1 | 6/2016 | Kueker et al. | |
| 2016/0206922 | A1 * | 7/2016 | Dalebout | G16H 20/30 |
| 2016/0354638 | A1 | 12/2016 | Carr | |
| 2017/0001075 | A1 * | 1/2017 | Butler, Jr. | A63B 24/0087 |
| 2017/0014673 | A1 | 1/2017 | Andrade | |
| 2017/0246500 | A1 | 8/2017 | Gatti et al. | |
| 2017/0333747 | A1 * | 11/2017 | Athey | A63B 71/0622 |
| 2017/0348559 | A1 | 12/2017 | Andrade | |
| 2018/0001134 | A1 * | 1/2018 | Bayerlein | A63B 22/0235 |
| 2018/0085651 | A1 * | 3/2018 | Russo | A63B 21/00192 |
| 2018/0104533 | A1 * | 4/2018 | Powell | A63B 22/0023 |

FOREIGN PATENT DOCUMENTS

| | | | |
|---|---|---|---|
| CN | 203135633 | U | 8/2013 |
| EP | 1584356 | B1 | 4/2008 |
| KR | 200360465 | Y1 * | 8/2004 |
| KR | 2003604650000 | Y1 | 8/2004 |
| KR | 200396992 | Y1 | 9/2005 |
| KR | 1020080021744 | A | 3/2008 |
| KR | 101623683 | B1 | 5/2016 |
| KR | 1020160124343 | A | 10/2016 |
| WO | 2004041367 | A2 | 5/2004 |

OTHER PUBLICATIONS

International Search Report, International Patent Application No. PCT/US2018/022702, dated Jul. 2, 2018 (18 pages).
Horizon Fitness, AFG Service Seminar, Models 1.0AT, 2.0AT, 3.0AT, 4.0AT, 5.0AT, 13.0AT, 14.0AT, 2.0AE, 3.0AE, 4.0AE, 14.0AE, 18.0AE, 2.0AR, 3.0AR, 4.0AR, 3.0AH, 4.0AH and 2.0AS, [rev 1.3], 2008 (74 pages).
Precor Inc. Service Manual, C956i, C966i Treadmill (Gen 06), 2006 (55 pages).

* cited by examiner

BRAKING MECHANISM FOR A SELF-POWERED TREADMILL

CROSS REFERENCE TO RELATED APPLICATION(S)

This application claims the benefit of U.S. Provisional Patent Application Ser. No. 62/618,800, filed Jan. 18, 2018, the entire disclosure of which is herein incorporated by reference.

BACKGROUND OF THE INVENTION

1. Field of the Invention

This disclosure relates to braking systems for exercise devices, such as treadmills, which utilize user locomotion to drive the machine at least part of the time. Specifically, the braking system is for an emergency brake which is triggered when power is cut to a treadmill which can operate in both a motor-powered and a self-powered mode.

2. Description of the Related Art

Today's conventional treadmills typically operate by employing a motor to rearwardly drive an endless belt upon which the user runs, walks, or otherwise engages in ambulatory leg movement, generally in a direction opposing the motion of the belt. As the user is moving in opposition to the belt, the user therefore "moves" in order to remain in place. Generally, a user of a conventional treadmill is able to vary the speed of the treadmill to obtain a desired level of workout by increasing the speed of the motor to accelerate the speed of the belt and increase their necessary movement speed. Alternatively, the user can make the workout more difficult by increasing the incline to simulate moving uphill. More sophisticated motorized treadmills, such as those described in U.S. Pat. No. 5,462,504, the entire disclosure of which is herein incorporated by reference, automatically adjust the speed and incline of the treadmill to control the heart rate of the user during the exercise.

Conventional treadmills of this type function to exercise the user's cardiovascular system (cardio exercise) and, to some extent, the skeletal muscles of the lower body. However, these types of treadmills, while simulating the exertion of walking or running, do not actually exercise the user in the same way a user that is actually running or walking exercises. To provide a different type of motion and attempt to fill this gap, there are also treadmills which do not use a motor to supply the belt's rotary motion. In many cases, these do not actually use a belt at all but use a series of rollers, or a "slat-type" conveyor in the form of a chain belt.

These types of machines rely on the user of the treadmill to provide their own locomotion which is then imparted to the belt and rollers. To allow for continuous in-place motion, self-powered or "motorless" treadmills traditionally are designed to support the endless belt on some incline such that the belt rotates rearwardly as a result of the weight and forward stride of the user overcoming belt friction. In effect, these types of treadmills add some resistance to the walking or running motion through the use of the internal friction of the components (often combined with purposeful friction creating components) and the need for the user to utilize their leg muscles to propel the belt or chain.

Self-powered treadmills, which are often referred to as "slat" treadmills as they conventionally utilize conveyor chains formed from a plurality of slats instead of a single endless belt, have some unique design problems, however. In a first instance, traditional self-powered treadmills cannot effectively use both incline and speed to independently alter exercise characteristics because the weight of the user, incline, and speed are all related. Therefore, when the incline is increased, the speed also increases and commonly the force required to overcome the friction of the belt components is reduced. Essentially, in a self-powered treadmill, while the user gains resistance from having to lift their body, the force of their body being pulled back down by gravity actually serves to counteract the force of friction of the belt components that the body needs to overcome. While in some cases this may be desirable, in many cases it is not.

A problem with self-powered treadmills is actually their need for relatively low internal friction which reduces the amount of work necessary to exercise on the machine. In order to allow the user to move the chain readily, especially at the start of an exercise, most self-powered treadmills either need to use substantial incline, or use relatively low friction structures in the cogs and roller bearings. While some friction is inherent in any mechanical system, self-powered treadmills often utilize components which are designed to move with relatively little resistance. For example, a user may run on a tread deck which is formed of a number of independent roller bearings. These roller bearings are commonly mounted on axles utilizing ball bearings or other low friction connections so that they readily rotate. In this way a user standing on the belt and pushing it into the tread deck does not create substantial friction between the tread deck and the belt which they would have to overcome as they begin to exercise.

While this structure provides for a smooth exercise once started, it creates new problems in that the ability to easily start a treadmill can also make it hard to stop and make it hard for the motion to provide substantial exercise. Further, it can be hard for a user to originally get on the belt prior to motion. Stepping onto a self-powered treadmill can be like stepping on a skateboard as the roller bearings can readily turn underfoot. This often means that a user needs to start the motion of the treadmill with one foot while still bracing with the other at a stationary point. Further, the same lack of friction which makes it easy to place the roller bearings and belt into motion, results in the roller bearings, and belt, when they are in motion, wanting to stay in motion.

Stopping of the belt or roller bearings generally takes place under two conditions. The first is when a user voluntarily wants to stop the exercise as they have completed it and the second is when the exercise machine needs to be stopped in an emergency or other situation where a user may not be in complete control of the machine to avoid user injury. In the first instance, the user can generally stop the rollers by simply slowing their stride and allowing their body to effectively be the resistance to the roller bearing motion relying on the slow accumulation of internal friction and the resistance of their musculature. This method, while potentially somewhat of an unnatural motion, is not particularly difficult or unsafe as it simply involves the user slowing to a stop. However, stopping in this fashion is completely dependent on the user being in control of their body and of the machine which is generally not the case in an emergency situation.

Safety concerns with stopping exercise machines in an emergency usually relate to concerns when a user using the machine has something happen where their interaction with the machine changes and takes control of user motion away from them. The biggest concern is the user becoming unstable on the machine and falling. In treadmills, for example, a user could land badly on a single step causing them to lose their balance and not be able to keep up with the moving belt for simply a matter of seconds. At high speed, continued belt movement can then cause them to fall due to rapid unbalancing or to be pushed off the machine or into its moving parts in a matter of seconds. Because of these problems, the vast majority of exercise machines (like most large electromechanical devices) provide an emergency shutoff and, in many cases, are required by law to provide such a system.

In exercise machines, the emergency shutoff generally requires the system to immediately lose power (e.g. electricity) and is traditionally of one of two forms. Some exercise machines, like many industrial manufacturing machines, provide for a large emergency shutoff button. While this can be an effective mechanism, an emergency shutoff button is problematic for an exercise machine as the need for a shutoff will generally relate to a user being off-balance and moving in a somewhat uncontrolled fashion which can make it difficult for them to reach or activate the button in the short time before injury is potentially inflicted. They can also be out of range of the button due to the issue creating the safety concern. Because of this, most exercise machines usually utilize a shutoff key and pull cord.

A traditional shutoff key generally comprises a thin plastic wafer or other "key" which is slotted into a mating slot on the front panel of the exercise device and held in place by friction. When slotted, the key serves to move internal components of the treadmill which then creates an electric circuit between the electrical source and other electromechanical devices on the exercise device. Thus, the exercise device is "powered" when the key is in position in the slot as the electrical circuit from the power source (generally a wall outlet) and the electrically driven or controlled components (most notably the motor) is completed. The key is attached to a cord which is, in turn, connected to a clothing clip.

Most safety keys are very simple and generally comprise a simple plastic shape that pushes two internal components into electrical connection internal to the machine. Most traditional safety keys are not themselves conductive to avoid any need of electricity to pass through them, and they instead will mechanically move components internal to the control systems of the exercise device into electrical contact to complete the circuit.

To use the exercise device, the user slides the key into the complimentary slot in the exercise device. When the key is so slotted, the exercise device has a complete circuit and is allowed to be powered. The user is supposed to attach the clothing clip to their clothing and commences their exercise in a standard fashion. Because of the cord connection, should a user move away from the key slot further than the length of cord, their movement will generally overcome the inherent friction and pull the key from the exercise device. Removal of the key immediately breaks the electrical connections in the exercise device and forces it to shut off as all motors and other electrical components lose their electrical connection.

As the key slots are generally positioned toward the front of the exercise device, a movement which will result in the cord being pulled is generally indicative of a person falling, moving backward, or otherwise not staying in the equilibrium position where the exercise is performed. Thus, should the user begin to fall, the machine's electronics will shut off and while the user may still fall (or may regain their balance) they will not fall into an operating machine.

It is important to recognize that the inclusion of a safety key in an exercise machine is often required by regulation and that such regulation regularly requires that the safety key completely cut off the electrical supply to the machine when pulled. This is a highly logical operation for a motor-powered treadmill as disconnecting the motor will cause the belt to rapidly stop. However, in a self-powered treadmill, it should be apparent that cutting complete power to the treadmill can actually create a new safety concern. Specifically, the purpose of the safety key is to inhibit motion of the tread belt, but in a self-powered treadmill, electricity does not always power the belt. Electricity often only powers the console and other control mechanisms. Thus, to stop the belt in an emergency situation, it is generally necessary to engage a brake on the belt of a self-powered treadmill. However, the safety key, by design and regulation, cuts the power that can be used to activate a brake.

SUMMARY OF THE INVENTION

The following is a summary of the invention, which should provide to the reader a basic understanding of some aspects of the invention. This summary is not intended to identify critical elements of the invention or in any way to delineate the scope of the invention. The sole purpose of this summary is to present in simplified text some aspects of the invention as a prelude to the more detailed description presented below.

Because of these and other problems in the art, discussed herein is a mechanical braking system which can provide a brake to a self-powered treadmill, or a dual mode treadmill that can operate in both self-powered and motor-powered modes, that will rapidly halt the motion of the belt or rollers in the event of a power disconnect such as from the removal of a safety key.

In an embodiment, there is provided herein a method for braking moving components of a treadmill, the method comprising: providing a treadmill including: a running deck having two belt rollers, a first belt roller disposed at a first end thereof and a second belt roller disposed at a second end thereof; a plurality of roller bearings disposed between the first belt roller and the second belt roller; a continuous belt disposed around the first belt roller and the second belt roller; an electric belt motor operatively coupled to at least one of the two belt rollers via a motor axle; and a mechanical brake; supplying the mechanical brake with electricity to disengage the mechanical brake; and removing the electricity supply from the mechanical brake to brake the continuous belt with the mechanical brake.

In an embodiment of the method, the mechanical brake is operatively attached to the electric belt motor and braking comprises the mechanical brake braking the electric belt motor.

In an embodiment of the method, when the mechanical brake is supplied with electricity, the electric belt motor is also supplied with electricity and turns the at least one of the two belt rollers.

In an embodiment of the method, the supplying the electric belt motor with electricity and the mechanical brake with electricity occur at about the same time.

In an embodiment of the method, when the mechanical brake is supplied with electricity the electric belt motor acts as a generator resisting rotation of the at least one of the two belt rollers.

In an embodiment of the method, the supplying the electric belt motor acting as a generator and supplying the mechanical brake with electricity occur at about the same time.

In an embodiment of the method, the mechanical brake is operatively attached to a flywheel on the motor axle and removing the electricity supply from the mechanical brake comprises the mechanical brake braking the flywheel.

In an embodiment of the method, the mechanical brake is operatively attached to the motor axle and removing the electricity supply from the mechanical brake comprises the mechanical brake braking the motor axle.

In an embodiment of the method, the mechanical brake is an electrically-released spring-set brake.

In an embodiment of the method, the mechanical brake is a pneumatic brake.

In an embodiment of the method, the mechanical brake is a hydraulic-set brake.

In an embodiment of the method, the removing of the electricity supply is caused by a power failure.

In an embodiment of the method, the removing of the electricity supply is caused by removing of a safety key from the treadmill.

In an embodiment of the method, the removing of the electricity supply is caused by completing or pausing a pre-programmed workout routine.

In an embodiment of the method, the continuous belt includes a plurality of slats.

In an embodiment of the method, the plurality of slats are mounted upon the continuous belt.

In an embodiment of the method, the plurality of slats are interconnected to form the continuous belt.

In an embodiment of the method, the mechanical brake includes a biasing means for engaging the mechanical brake when the electricity supply is removed.

In an embodiment of the method, the biasing means comprises one or more springs.

DETAILED DESCRIPTION OF THE PREFERRED EMBODIMENT(S)

Figure 1:
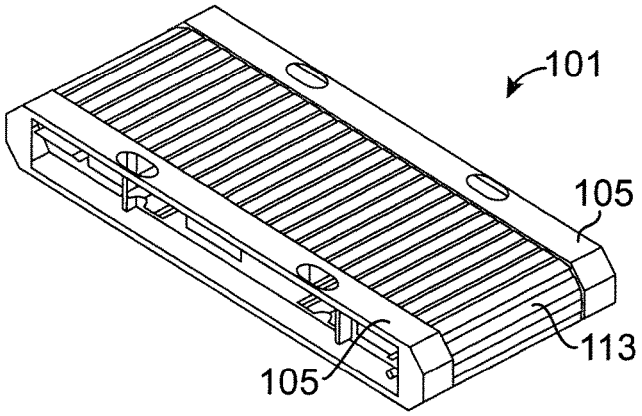
FIG. 1 provides a perspective view of an embodiment of running deck for a variable motor-powered/self-powered treadmill exercise machine that may utilize braking systems as contemplated herein.

It should be recognized that the disclosure herein is focused on treadmills which utilize a running belt formed of individual slats (a conveyor chain) interacting with a continuous belt to provide the exercise as this is the device primarily pictured in the FIGS. While this is a valuable exemplary embodiment, one of ordinary skill in the art would understand that such structure is by no means required and the treadmill may use other kinds of belts such as continuous fabric belts or pure conveyor chains.

On many typical slat treadmills, the slats are built from aluminum "T" shaped pieces that are overmolded by rubber or another high grip and compactable surface and then connected to each other by being secured onto a belt at the edge of the slats or by being interconnected together. Typical belts for slat treadmills comprise two portions. The first portion of a typical belt may include features designed to interface with a cog (or other rotation-assisting means known in the art) at both ends of the frame until the slats form a continuous loop in order to facilitate the rotation of the belt. The first section may be formed towards the end of the belt that is closest to the exterior of the slat treadmill. The second portion of a typical belt may include a flat, or relatively featureless, portion that interfaces with an idler wheel. The communication between the second portion of the typical belt and the idler wheel may assist the slat treadmill in reducing vibrations communicated between the frame and the loop of slats and in reducing stress imparted on the cog teeth from the belt. At the ends of the frame, this loop rolling around the cog helps to control the speed of the user and control the tension to make sure that the belt or chain does not slip.

Between these cogs at the ends of the frame, there are commonly one or two rows of small roller bearings at the edges of the slats which provide the support for the slats on the tread deck. These rollers both allow the chain to move freely and also provide enough support so that there little to no deflection of the slats when a user runs on the tread surface. The frames supporting the rollers are then rigidly mounted to the rest of the frame of the treadmill. This structure provides virtually no softness in the unit as rigid slats are in contact with rigid roller bearings rigidly mounted to a frame which is positioned on the rigid floor surface the treadmill is resting on. This creates an extremely firm feeling machine which can cause discomfort while running.

Further, while the above structures describe typical slat treadmills upon which the braking systems and methods discussed herein can be used, the systems and method discussed herein are also not limited to treadmills. Other types of exercise machines such as, but not limited to, ellipicals, exercise bikes, stairmills, Jacob's Ladder systems, and other machines that utilize an endless repeating motion of the user's legs and/or arms to drive them can benefit form being able to be braked when power is disconnected.

Figure 2:
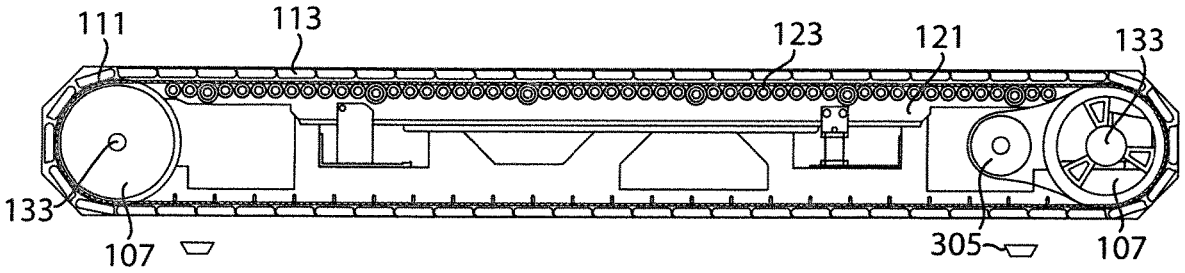
FIG. 2 provides a side view of the embodiment of FIG. 1.
Figure 3A:
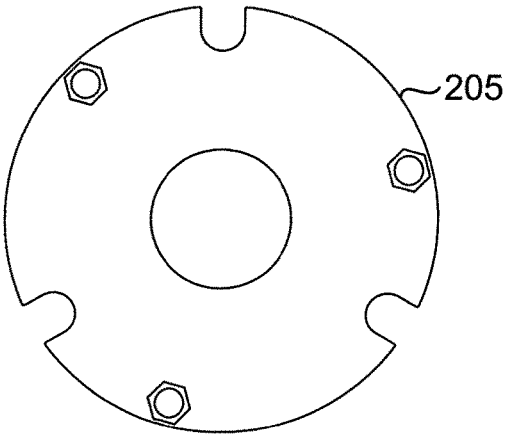
FIGS. 3A-3D depicts an embodiment of a mechanical brake according to the present disclosure.
Figure 3C:
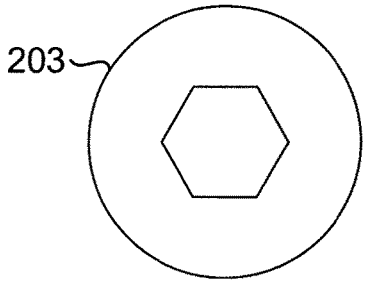
Figure 3B:
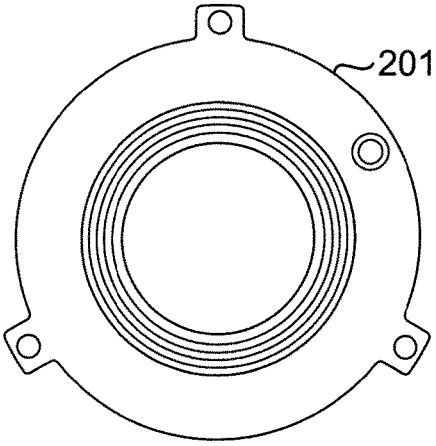
Figure 3D:
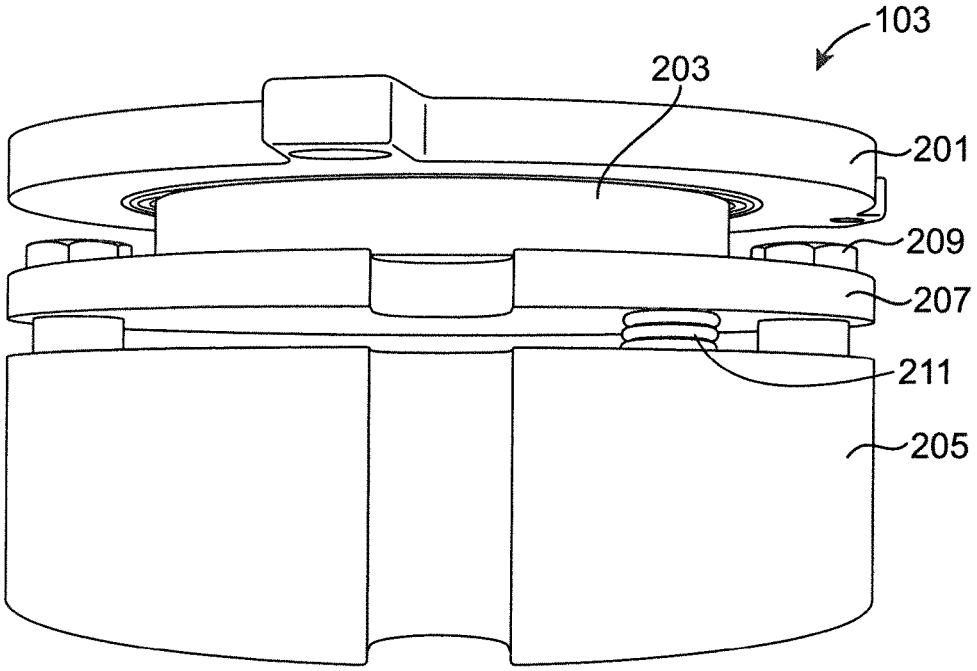

FIGS. 1 and 2 provides an embodiment of a running deck (101) of an alternatively motor-powered and self-powered treadmill. Such a treadmill may, for example, be designed and operate in conjunction with the provisions of U.S. Utility patent application Ser. No. 15/986,420, the entire disclosure of which is herein incorporated by reference. The treadmill for use with the running deck (101) may operate, in an embodiment, in conjunction with just two alternative modes of operation. Specifically, the motion of the belt (111) will generally take at least two forms in conjunction with alternative modes of operation. In the first mode a provided motor (305) will serve to drive the belt (111) in a manner where a user will move to keep up with the rotation of the belt (111). In the second mode of operation, the user will have to utilize the friction between their feet and the belt (111) along with the musculature of their lower body to cause the belt (111) to rotate. In this case, the motor (305) will generally freewheel or be disengaged from the belt (111). There is an optional third mode of operation provided in some embodiments, such as that discussed in Utility application Ser. No. 15/986,420 referenced above, which provides that the motor (305) either assist or resist the motion imparted by the user, but not completely supply it or be disconnected.

Use of the motor (305) in a self-powered treadmill generally serves to provide for flexibility. A motor (305) which is unpowered (not connected to electricity) will effectively act as an electrical generator when it is forced to turn. Further, connecting the motor (305) to some form of a load (a resistor, storage capacitor, heat sink, or anything else) can allow for the motor (305) to provide for a variable level of resistance to rotation of the belt (100). Further, that level of resistance can potentially change.

As contemplated in the applications discussed above, a motor (305) can be used to provide for a motor assist to a user, where the motor (305) turns the belt (111) in the same direction that the user is attempting to move it with their feet. This allows for the belt to be more easily started move from rest, for example. The motor (305) may alternatively have no power and act as a generator which can serve to provide for resistance to movement of the belt (111). This can provide for a slightly more stable mounting and dismounting or can provide for increased difficulty in moving the belt to provide for a more difficult exercise. Still further, the motor (305) can attempt to move the belt (111) in opposition to the direction the user wishes to move it. This can provide for active resistance to the user and a much more difficult exercise. Thus, there is a benefit to having a motor (305) in the treadmill even if the treadmill is operated in more traditional self-powered type modes where the motor (305) does not serve to turn the belt (111) with the user simply moving to keep up with the belt (111) motion.

The running deck (101) comprises a roller frame (121) surrounded by a continuous belt (111). The running deck (101) will also commonly include two sidewalls (105) on either side of the belt (111) to provide for the user to have a place to step on and off the belt (111). The sidewalls (105) are stationary components generally formed as part of the treadmill's frame. The belt (111) comprises a plurality of slats (113) upon which the user will run which will commonly be attached to an underlying continuous loop of material. This allows for the belt (111) to be given direction and motion by two belt rollers (107) with one attached toward each of the opposing ends of the running deck (101). This is as opposed to using cogs, but alternative embodiments may utilize cogs instead of or in addition to the belt rollers (107). The running deck (101) may be attached to additional frame components (not shown) which are used to provide hand grips, arm drives, lift mechanisms, support feet, and other related frame components and elements as known to those of ordinary skill in the art to provide functionality and usability to treadmills and other exercise machines.

The roller frame (121) will generally include a plurality of roller bearings (123) which serve to support the belt (111). While the belt (111) will generally be tensioned via the rollers (107), it should be recognized that a user moving on the belt between the rollers (107) will generally cause the belt (111) to deflect inward between the rollers (107) at least some amount and regardless of the amount of tension applied to the belt (111). To avoid damage to the belt (111) or rollers (107) and to provide sufficient stiffness to the belt (111) to keep the user from sagging into it, the plurality of roller bearings (123) serve to support the belt (111) as it is passing over the roller frame (121). A user will generally be expected to walk or run on the belt (111) when it is above the roller frame (121) and therefore the combination of roller frame (121) and the plurality of roller bearings (123) will serve to support the user's mass and inhibit deformation of the belt (111) during exercise.

There will also generally be attached to the running deck (101) a computer system (not shown), which is connected to a user interface. The user interface may be as simple as dials or buttons, or may be more complex, including touch-activated screens and other computer-like interface features. When a user pushes buttons on the interface or the screen, electrical signals are sent to electrical components of the system such as sensors or motors to control incline of the running deck (101) as well as to motor (305).

Figure 4:
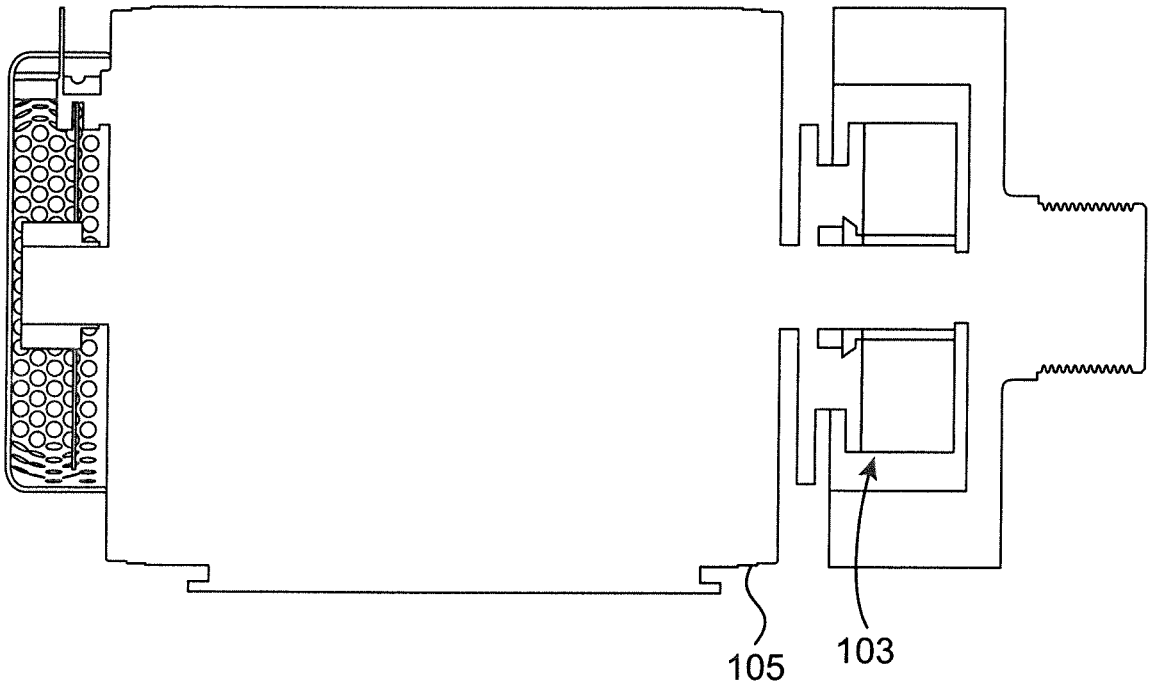
FIG. 4 depicts sectional view of an embodiment of the mechanical brake of FIGS. 3A-3D attached to a roller.

FIGS. 3 and 4 illustrate a mechanical brake (103) that is generally mountable on the running deck (101) at a position disposed on the motor (305) and associated with either of the rollers (107) depending on how the motor (305) serves to drive the belt (111). In an alternative embodiment, the mechanical brake (103) may be attached to a flywheel which may be present to provide for smoothness of motion on either of the rollers (107), or may be attached to the roller bearings (123). Those embodiments are not illustrated herein but operate according to the same principles discussed herein.

Upon engagement of the brake (103), the typical operation will result in the brake (103) engaging either the flywheel, the motor (305), the associated roller (107), or the axle between them (generally the rotor of the motor (305)) in a way that effectively locks the axle, and thus the belt (111) in a fixed position. This may be through a variety of mechanisms, but may be through having an extremely high frictional engagement between the brake (103) and rotational components (rotor) of the motor (305). In the depicted embodiment, the motor (305) will have attached thereto a brake mount (201) with which a brake pad (203) will engage to halt the rotor of the motor. FIGS. 3A-3D shows an embodiment of a mechanical brake (103) mounted to the electric motor (305) of a treadmill (101).

As would be understand by one of ordinary skill in the art, a mechanical brake (103), such as that depicted in FIGS. 3A-3D may be used to carry out this activation. The brake depicted in FIGS. 3A-3D is of the type commonly called an electrically-released spring-set brake. While this general design is preferred for simplicity, pneumatic or hydraulic-set brakes may also be used in alternative embodiments.

The brake (103) as depicted in FIGS. 3A-3D primarily comprises a brake mount (201), a brake pad (203), an armature (207), and a brake coil (205). The brake mount (201) is a structure sized and shaped to mount the mechanical brake (103) to the treadmill motor (305) (or another motor, if used with a device other than a treadmill). Attachment of the brake mount (201) to the motor (305) is typically done using hardware, such as bolts, but other means for such mounting will be familiar to one of ordinary skill in the art.

Generally, the brake mount (201) will be rigidly mounted to a non-moving component of the motor (305) such as the stator and will allow for rotational components (the rotor) of the motor (305) to turn through it. In an embodiment the brake mount (201) will mount to the stator coil or housing of the motor (305) and allow access to at least a portion of the rotor coil of the motor (305). In an alternative embodiment, the brake mount (201) will be mounted to an alternative static component such as the frame of the treadmill.

The brake pad (203) is generally a structure known to be used in braking systems. The brake pad (203) causes the braking action by the brake pad (203), which is attached to the rotor in a non-rotational fashion, being pressed against a braking surface to be stopped. In the embodiment of FIG. 2, the brake pad (203) will be pushed toward the brake mount (201) by the armature (207) sandwiching the brake pad (203) between the brake mount (201) and the armature (207). The brake pad (203) will typically have a surface made of a material having an extremely high coefficient of friction so that contact of the brake pad (203) to the brake mount (201) and armature (207) will result in dramatic loss of energy from the rotor which is engaged in the center of the brake pad (203) in a non-relative-rotational fashion (that is, the rotor and the brake pad (203) rotate together). The kinetic energy of the rotor is converted by brake pad (203) to heat. This will quickly slow or stop the rotor of the motor (305). In the embodiment of FIGS. 3A-3D, the brake pad (203) is a disc designed to connect to the rotor.

To alternatively engage and disengage the brake pad (203) there is an armature (207) which is attached in a constrained relationship to the brake coil (205). Specifically, the armature (207) will be allowed a constrained movement toward and away from the brake coil (205). In the depicted embodiment of FIGS. 3A-3D, the movement is constrained by the presence of bolts (209) which provide that the armature (207) can only move generally linearly toward and away from the brake coil (205) and the distance of that movement is constrained by the brake coil (205) itself on one side, and the bolt (209) head on the other.

In order to provide for braking, the armature (207) will be biased via a biasing mechanism, which are springs (211) in the brake (103) of FIGS. 3A-3D, away from the brake coil (205) and at the extreme distance of throw toward the brake mount (201). This will cause the brake pad (203) to be sandwiched between the brake mount (201) and the armature (207) to frictionally resist the movement of the brake pad (203) and, thus, rotation of the rotor in the motor (305). In order to allow for free motor (305) movement, power is provided to the brake coil (205) which will be energized and act as an electromagnet pulling the armature (207) toward the brake coil (205) against the biasing of the springs (211). This will release the brake pad (203) from the sandwiching arrangement and allow it to turn.

As should be apparent from the above, the mechanical brake (103) is in "braking" position when unpowered. That is, the flow of electrical energy through the mechanical brake (103) causes the brake coil (205) to withdraw the armature (207) from the brake pad (203) thus permitting rotary motion of the motor (103). When power is disengaged, the lack of electricity through the brake coil (205) ceases the magnetic force being generated in the brake coil (205) and causes the armature (207) to move toward the brake pad (203) engaging the brake.

For use in a treadmill (101), the arrangement of powered and unpowered operation of the brake (103) is particularly important. If the power is cut for any reason, the mechanical brake (103) of FIGS. 3A-3D will immediately respond by the springs (211) pushing the armature (207) toward the brake pad (203), causing the brake pad (203) to be sandwiched slowing or stopping rotor rotation. Further, the armature (207) cannot be withdrawn until power is restored. This prevents the treadmill from freewheeling in the event of a loss of power, improving user safety as the brake pad (203) is engaged unless it is actively unengaged.

In the operation of the treadmill of a type contemplated in FIGS. 1 and 2, prevention of motion while freewheeling provides for particular value. In the first instance, the brake (103), when engaged, will cause the motor (305) to cease motion when the treadmill is in self-powered mode. As discussed above, the motor (305) in this case is disengaged and is freewheeling. Specifically, the rotor and stator are still rotating relative each other but there is no, or minimal, electromechanical engagement, only friction between them. However, should the stator and rotor of the motor (305) be rigidly held in position by the brake (103), the motor (305) is still connected to at least one roller (107) and, therefore, stopping motion of the motor (305) will stop motion of the roller (107) and the belt (111). Further, in a powered mode of operation, the brake engaging the motor (305) will serve to stop the motor (305) and keep it from freewheeling even after dissipation of electromagnetic fields. This process is discussed in additional detail in U.S. Utility patent application Ser. No. 15/861,437 the entire disclosure of which is herein incorporated by reference.

Finally, should the treadmill be operating in a third "middle" mode where the motor (305) is assisting or resisting motion as contemplated in U.S. Utility application Ser. No. 15/986,420 referenced previously, the brake (103) will also serve to halt motion of the belt (111) and keep the belt (111) from moving even after electromechanical forces have dissipated. In effect, the brake (103) serves to both stop the belt (111) in all modes of operation and regardless of the use of the motor (305) in the exercise motion, and serves to hold the motor (305) and, thus, the belt (111) in position after disengagement of power in all modes of operation. This is as opposed to traditional systems which simply utilize the sudden relative reversal of magnetic field in the motor (305) upon power disconnection to provide the only brake which can allow the motor to freewheel after the fields have dissipated.

In a treadmill (101), the primary concern for safety is typically a fall of the user who is running or walking on the treadmill (101). Should such an event occur, having the belt (111) and other moving components very quickly come to a halt and stay halted eliminates much of the risk of these moving components presenting a pinch hazard and can dramatically reduce danger from the machine. As discussed previously, treadmills (101) have traditionally utilized a safety key which, when pulled, disconnects all power to all components of the treadmill (101). The safety key is designed to be pulled and disconnect power by a simple circuit breaker when a user has moved sufficiently away from the control panel to indicate the start of a fall. Thus, the belt (111) and other moving components are designed to have stopped prior to the fall actually completing and the user falling on the belt (111) or other moving components. The safety key has now become ubiquitous and is actually required on some treadmills (101) due to regulations.

The problem with traditional motor braking in a treadmill (101) when the safety key is pulled is that while the power disconnection is effective at stopping the belt (111) motion on a flat surface when the belt (111) is being driven by the motor (305), it is not effective at maintaining the belt (111) in a stopped position after the power is disconnected, as the belt (111) can freewheel once the magnetic fields in the motor (305) have dissipated. Further, an induced field in the motor (305) does not assist when the motor (305) is not moving the belt in the same direction as the user which can be problematic when the motor (305) is being used to provide resistance and not speed. Further, the disconnect cannot stop a treadmill which is self-powered where the motor (305) is freewheeling as electrical disconnect has no effect on such a motor (305).

As indicated, the depicted mechanical brake (103) serves to not only assist in rapidly stopping the motor (305), but remains engaged unless and until power is restored. Thus, the brake (103) serves to keep the motor (305), and thus the belt (111) and other components, from freewheeling or otherwise moving even after dissipation of the induced fields and regardless if the motor (305) was powered or not (and regardless of such powered direction) at the start of braking. Thus, the mechanical brake (103) provides for additional safety in treadmill (101) operation.

Further, having the brake (103) engaged when there is no power also allows a user to stand on the running deck (101) prior to an exercise with the motion of the belt (111) being stopped. They can then insert the safety key into the control panel to unlock the belt (111). As they are stable on the belt (111) and may utilize hand grips which are part of the machine for further stability when this happens, concerns related to stepping onto the belt (111) from the sidewalls (105) are generally eliminated and the user generally will have an easier time mounting the treadmill.

Mounting the treadmill is also made easier as there is now no need for a user to stand on the roller bearings (123) at any time when they can freewheel. The roller bearings (123) are typically very unstable to stand on and will readily rotate. However, because of the presence of the belt (111) the roller bearings (123) can only rotate if the belt (111) can rotate. If the treadmill is without power, the motor (305) will be locked in position by the brake (103) effectively preventing the belt (111) from moving. When power is supplied to the motor (305), the motor will then resist motion of the belt (111) through electromechanical fields which will exist in preparation for driving the belt (111). Thus, in both powered and unpowered operation of the motor (305), it is generally unlikely that the belt (111) can move on the roller bearings (123) with any ease making it much easier to mount the present running deck (101).

It is recognized that the amount of brake force which is ideally applied may depend on the braking situation presented, as well as the angle of the belt (111) and the mass of the user. For example, a much more rapid and stronger brake force is generally preferred when the safety key is pulled for a heavy user on a high incline moving at high speed. A lower braking force will generally be preferred when the treadmill (101) is manually stopped at a level incline and lower speed as would be typical of a user finishing their workout. In order to provide for differing brake force to be applied in different circumstances, the brake (103) may be connected to various sensors or switches to assist in the brake (103) application. For example, a switch and/or sensor may be used to trigger different reactions from the mechanical brake (103) only at certain belt (111) speeds or if the user's mass is detected to be above a certain threshold. In an alternative embodiment, a second electrical brake may also be supplied which can be used to slow or stop the belt (111) when power is present. This can allow the user to more easily come to a stop at the conclusion of a workout and when a safety situation does not exist.

As the mechanical brake (103) engages should the power be disconnected, in the event of a power outage, the sudden engagement of the brake (103) when it is not really needed to avoid continuing motion after a user fall, could actually produce a dangerous situation where the sudden braking could cause a user to pitch forward into the rest of the treadmill. As should be apparent, such risk (if it is a concern) can be reduced by only having the mechanical brake (103) be armed to engage when the benefit outweighs any potential risk. This can be carried out by including circuitry to determine if a secondary power system should be supplied to the mechanical brake (103) or other sensors or systems should be engaged to control mechanical brake (103) operation.

In the depicted embodiment, the brake (103) may be actuated upon the occurrence of any number of braking events. These may include, without limitation: the safety key is pulled; a pre-programmed workout routine has been completed or paused; the stop button has been pushed; or the machine loses power. The specific actuation of the mechanical brake (103) may also be different in the different scenarios both in the timing of the actuation of the brake (103), the specific brake force provided, and the speed at which the force is provided. Generally, the mechanical brake (103) will be designed to operate in a "brake safe" arrangement where any situation which results in stoppage of the treadmill belt (111) will engage the mechanical brake (103) either immediately or shortly after other braking systems that may be present in the treadmill.

Also, although not necessary, in a still further embodiment the brake (103) can also be used to provide a variable frictional resistance mechanism to the treadmill. Specifically, the brake pad (203) may be engaged in a manner that does not force the relative motion of the stator and rotor to stop under normal loads, but does provide some amount of resistance to the rotation. This can allow the brake (103) to regulate the amount of force needed to be generated to drive the belt (111) by a user, by providing an adjustable frictional force against movement of the belt (111) while the motor (103) is freewheeling. This can be useful to increase or decrease the strenuousness of the exercise in the self-powered mode. Such a partial braking will generally not be used in a powered mode as the motor (103) would simply be fighting the braking force which does not alter the exercise and wastes power.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

Finally, the qualifier "generally," and similar qualifiers as used in the present case, would be understood by one of ordinary skill in the art to accommodate recognizable attempts to conform a device to the qualified term, which may nevertheless fall short of doing so. This is because terms such as "sphere" are purely geometric constructs and no real-world component is a true "sphere" in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and relationships contemplated herein regardless of the inclusion of such qualifiers to include a range of variations from the literal geometric meaning of the term in view of these and other considerations.

The invention claimed is:

1. A method for braking moving components of a treadmill, the method comprising:

providing a treadmill including:

a running deck having a first belt roller disposed at a first end thereof and a second belt roller disposed at a second end thereof;

a plurality of roller bearings mounted to said running deck at fixed positions between said first belt roller and said second belt roller;

a continuous belt disposed around said first belt roller and said second belt roller;

an electric belt motor operatively coupled to at least one of said two belt rollers via a motor axle; and a mechanical brake including:

a brake mount rigidly mounted to said motor with said motor axle extending and rotating therethrough;

a brake pad rigidly mounted to said motor axle;

an armature; and a biasing mechanism biasing said armature against said brake pad and said brake pad against said brake mount;

supplying said mechanical brake with electricity to disengage said mechanical brake by moving said armature against said biasing to disengage said armature from said brake pad; and removing said electricity supply from said mechanical brake to brake said continuous belt by allowing said biasing to engage said brake pad and push said armature into said brake pad and said brake pad into said brake mount.

2. The method of claim 1 wherein when said mechanical brake is supplied with electricity, said electric belt motor is also supplied with electricity and turns said at least one of said two belt rollers.

3. The method of claim 2 wherein said supplying said electric belt motor with electricity and said mechanical brake with electricity occur at about the same time.

4. The method of claim 1 wherein when said mechanical brake is supplied with electricity said electric belt motor acts as a generator resisting rotation of said at least one of said two belt rollers.

5. The method of claim 4 wherein said supplying said electric belt motor acting as a generator and supplying said mechanical brake with electricity occur at about the same time.

6. The method of claim 1 wherein said removing of said electricity supply is caused by a power failure.

7. The method of claim 1 wherein said removing of said electricity supply is caused by removing of a safety key from said treadmill.

8. The method of claim 1 wherein said removing of said electricity supply is caused by completing or pausing a pre-programmed workout routine.

9. The method of claim 1 wherein said continuous belt includes a plurality of slats.

10. The method of claim 9 wherein said plurality of slats are mounted upon said continuous belt.

11. The method of claim 9 wherein said plurality of slats are interconnected to form said continuous belt.

12. The method of claim 1 wherein said biasing mechanism comprises one or more springs.

13. The method of claim 1 wherein said first belt roller and said Second belt roller include cog teeth for interfacing with said continuous belt.

14. The method of claim 1 wherein said continuous belt rolls over said plurality of roller bearings.

* * * * *